US007447462B2

(12) United States Patent
Nishimura et al.

(10) Patent No.: US 7,447,462 B2
(45) Date of Patent: Nov. 4, 2008

(54) IMAGE FORMING APPARATUS WITH EXHAUST DUCT

(75) Inventors: Yoshiteru Nishimura, Nagano (JP); Toru Tanjo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 290 days.

(21) Appl. No.: 11/298,909

(22) Filed: Dec. 9, 2005

(65) Prior Publication Data

US 2006/0147223 A1 Jul. 6, 2006

(30) Foreign Application Priority Data

| | | |
|---|---|---|
| Dec. 9, 2004 | (JP) | P2004-356712 |
| Dec. 9, 2004 | (JP) | P2004-356713 |
| Dec. 9, 2004 | (JP) | P2004-356714 |
| Dec. 9, 2004 | (JP) | P2004-356715 |
| Dec. 16, 2004 | (JP) | P2004-363929 |

(51) Int. Cl.
*G03G 15/20* (2006.01)

(52) U.S. Cl. ..... 399/92

(58) Field of Classification Search ..... 399/92–96, 399/107

See application file for complete search history.

(56) References Cited

FOREIGN PATENT DOCUMENTS

| | | |
|---|---|---|
| JP | 07-234626 | 9/1995 |
| JP | 2003-186326 | 7/2003 |

*Primary Examiner*—Hoang Ngo
(74) *Attorney, Agent, or Firm*—Hogan & Hartson LLP

(57) ABSTRACT

A medium is adapted to be transported in a first path. An image former is operable to form an image on at least one face of the medium. A fuser is operable to fix the image on the medium. A discharger is operable to discharge the medium. A duct is arranged between the fuser and the discharger, and is adapted to exhaust air at opposite sides of the first path.

7 Claims, 7 Drawing Sheets

IMAGE FORMING APPARATUS WITH EXHAUST DUCT

BACKGROUND OF THE INVENTION

The present invention relates to an image forming apparatus which causes a recording sheet on which a toner image has been transferred in an image forming section, to pass through an image fuser having a heating roller, thereby fixing the toner image on the recording sheet, and thereafter discharging the recording sheet to a discharge section by means of a discharge roller, and which has a duct, such as an exhaust air duct or a draft air duct. More particularly, the invention relates to an art for exhausting air from the inside of the image forming apparatus.

A related image forming apparatus includes an exhaust air duct for sucking air of a desired section within the apparatus and exhausting the air. Another related image forming apparatus include a draft air duct for blowing air to a desired section within the apparatus.

A related image forming apparatus in which, for the purpose of preventing a heating member from having inconsistent temperature distribution in its longitudinal direction, ribs are provided on a member covering an upper portion of the heating member along a direction crossing an air flow direction. The aperture areas of regions partitioned by the ribs are changed along the air flow direction (see, e.g., JP-A-07-234626).

A related image forming apparatus in which, for the purpose of suppressing temperature rise of a member which is disposed in the vicinity of the fuser and which may be accessed by a user's hand, without sacrificing fixing performance, the image forming apparatus is configured such that a recording medium on which an image has been formed, is subjected to fixing operation with use of a fuser, and the thermally-fixed recording medium is discharged to a discharge section disposed on an upper portion of the image forming apparatus; and is provided with a vent hole formed in a bottom portion arranged in the vicinity of an end portion of the discharge section located at a side of the fuser (see, e.g., JP-A-2003-186326).

When a recording sheet passes through a fuser to thus be heated, water vapor is emitted from the recording sheet. When a sheet guide, and the like, forming a transport path of the recording sheet are at a low temperature, condensation forms on the surface of the sheet guide, or the like. This condensation can stain the recording sheet, and hinder smooth transportation of the recording sheet.

The above-described related-art image forming apparatus is configured so as to exhaust air of only one side of the recording sheet having passed through the fuser. Accordingly, since water vapor on the other side of the recording sheet is not exhausted, condensation is formed on the surface of the sheet guide, and the like, which has led to staining of the recording sheet, and hindered smooth transportation of the recording sheet.

In the above-described related-art image forming apparatus, the aperture areas of the regions partitioned by the ribs in the duct are varied only by means of the air flow direction. Therefore, only a single air path communicating with the aperture areas is provided, and merely an end portion of the single air path opposes the fan. Rectification by means of the ribs is not attained. Accordingly, by means of such a configuration, a region of the fan where a suction force or a blast force provided by the fan is strong and a region where the same is weak cannot be utilized effectively, that is, effective exhaust is prevented.

In the above-described related-art image forming apparatus, one face of the duct is formed from a plate-shaped material. Accordingly, the apparatus has a problem in that the duct is increased in thickness, and, accordingly, in weight. Therefore, in a case where a duct is disposed in a door member (e.g., a door cover) of an image forming apparatus, there arises a problem in that the cover is increased in thickness, as well as in weight.

SUMMARY

It is therefore an object of the invention to provide an image forming apparatus which can transport a recording sheet having undergone fixing, smoothly and without staining the same.

It is also an object of the invention to provide an image forming apparatus which can effectively utilize a region of the fan where a suction force or a blast force provided by the fan is strong, and a region where the same is weak, that is, perform effective exhaust or air draft from and to desired portions.

It is also an object of the invention to provide an image forming apparatus whose door cover having a duct can be reduced in profile and weight.

In order to achieve the object, according to the invention, there is provided an image forming apparatus comprising:

a first path, in which a medium is adapted to be transported;

an image former, operable to form an image on at least one face of the medium;

a fuser, operable to fix the image on the medium;

a discharger, operable to discharge the medium;

a duct, arranged between the fuser and the discharger, and adapted to exhaust air at opposite sides of the first path.

The medium on which the image is formed may be passed through the fuser from a lower side to an upper side of the image forming apparatus in a first direction.

The medium may be discharged by the discharger in a second direction substantially perpendicular to the first direction.

The image forming apparatus may further comprises a guide member, forming a part of a second path which is connected to the first path and in which the medium is adapted to be transported to the image former while turning inside out, and disposed at an upper side of the fuser.

The fuser may include a pair of heating rollers.

The fuser may include a pair of heating rollers, and one of the heating rollers which is located at a downstream side in the second direction may be higher in temperature than the other heating roller.

The duct may extend in an axial direction of the fuser and communicate with a single fan at a terminal end of the duct.

According to the invention, there is also provided an image forming apparatus, operable to form an image on a medium, comprising:

a duct, provided with a plurality of vent ports;

a fan, provided at a terminal end of the duct; and a plurality of air paths are provided with the duct, each of the air paths communicating with at least one of the vent ports and the fan, wherein a first part of the fan is operable to generate a first force, a second part of the fan is operable to generate a second force, the first force is greater than the second force, the air paths include a first air path and a second air path, a length of the first air path is longer than a length of the second air path, and the first air path communicates with the first part and the second air path communicates with the second part.

According to the invention, there is also provided an image forming apparatus, operable to form an image on a medium, comprising:

a duct, provided with at least one of vent ports and a rib-shaped guide adapted to guide the medium in a guiding direction, the rib-shaped guide arranged at an outer side of the duct adjacently to the vent port, the inside of the duct divided by a partition plate into a plurality of air paths, each of which communicating with at least one of the vent ports, wherein the rib-shaped guide and a first part of the partition plate which is adjacent to the vent port are aligned with each other.

The outer surface may be inclined with respect to the guiding direction, and the vent port may be located at an upper portion of the outer surface in the guiding direction.

A second part of the partition plate may be connected to the first part of the partition plate and be bent with respect to the first part of the partition plate.

According to the invention, there is also provided an image forming apparatus, operable to form an image on a medium, comprising:

a door cover;

a duct, integrally formed with the door cover, wherein a first surface of the duct is comprised of a sheet member.

A second surface of the duct may be opposed to the first surface and comprise a guide adapted to guide the medium.

The duct may be located at an upper side of a fuser operable to fix the image on the medium, and the sheet member may be arranged between the door cover and the fuser.

DETAIL DESCRIPTION OF PREFERRED EMBODIMENTS

Hereinafter, an embodiment of an image forming apparatus according to the invention will be described by reference to the drawings.

Figure 1:
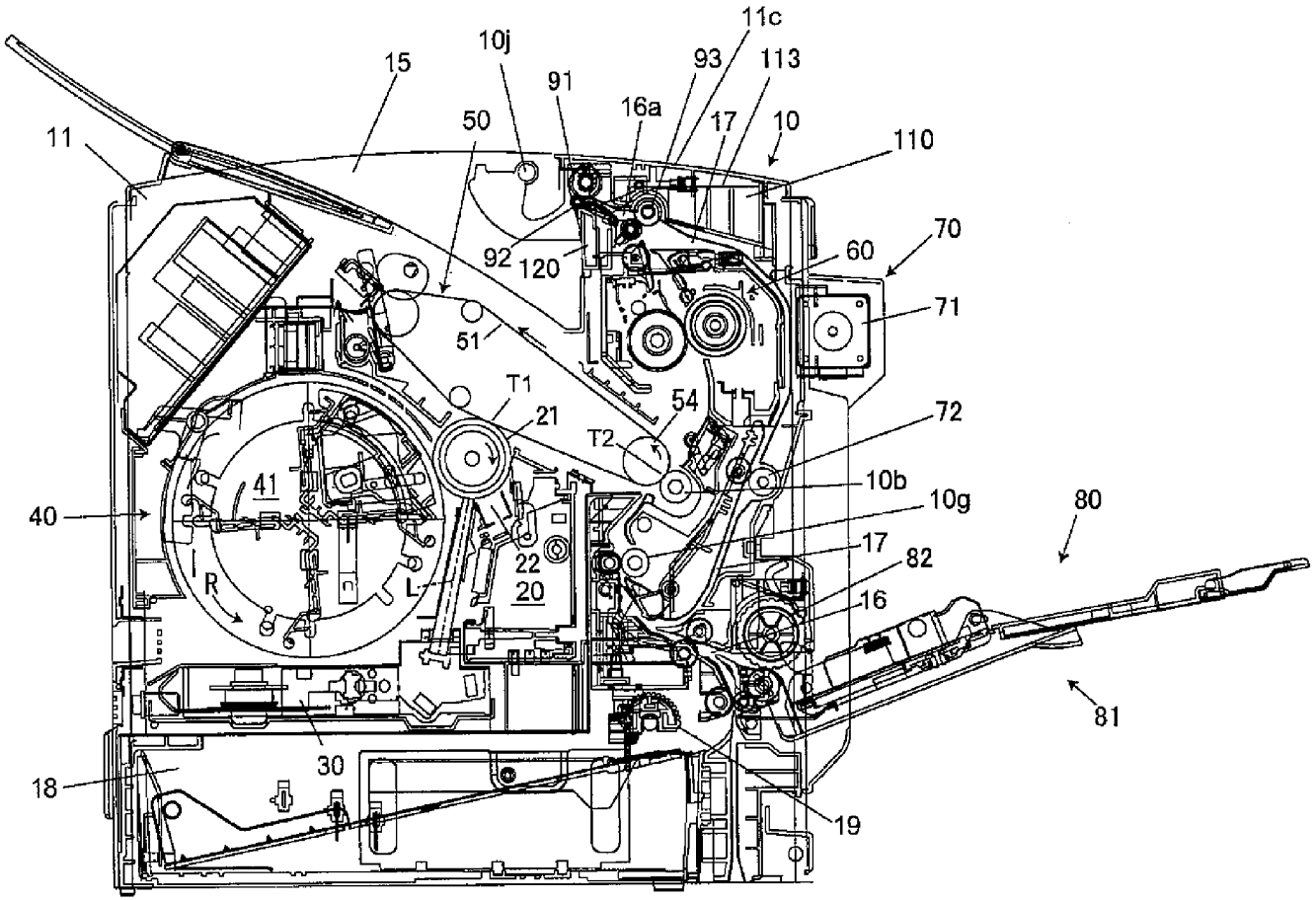
FIG. 1 is a schematic front view illustrating an internal configuration of an embodiment of an image forming apparatus according to the invention.

As shown in FIG. 1, the image forming apparatus is a color-image forming apparatus which can perform sheet-feeding of a recording sheet of A4 size (including letter size) in its longitudinal direction, and form a color image on double side of the sheet. The image forming apparatus has a housing 11, an image carrier unit 20, an exposure unit 30, and a developer 40 which are housed in the case 11. The image forming apparatus also includes an intermediate transfer unit 50, and a fixing unit (a fuser) 60.

An unillustrated frame of an apparatus main body 10 is disposed on the housing 11, and the respective units, and the like, are attached to this frame.

The image carrier unit 20 has a photosensitive member 21 having a photosensitive layer on the peripheral surface thereof, and a corona electrifying device (a scorotron electrifying device) 22 for uniformly electrifying the peripheral surface of the photosensitive member 21. The peripheral surface of the photosensitive member 21 having been uniformly electrified by the corona electrifying device 22 is selectively subjected to exposure with use of a laser beam L radiated from the exposure unit 30, to thus form an electrostatic latent image. The development unit 40 adheres toner, serving as a developing agent, onto the electrostatic latent image, to thus develop a visible image (a toner image). A primary transfer section T1 performs primary transfer of the toner image to an intermediate transfer belt 51 which is an intermediate transfer member of the intermediate transfer unit 50. Furthermore, a secondary transfer section T2 performs secondary transfer of the image onto a recording sheet that is an object of the transfer operation.

Inside the housing 11, there are disposed a transport path 16 for transporting a recording sheet on a single side of which an image has been formed by the secondary transfer section T2, toward a discharge section (a sheet-discharge tray) 15 on the upper face of the housing 11, and a return path 17 for causing switch-back of the recording sheet having been transported toward the discharge section 15 by way of the transport path 16, thereby returning the recording sheet toward the secondary transfer section T2 so as to form an image also on the other side.

A double-sided image-forming unit 70 is configured so as to be detachable from the apparatus main body and forms a part of the return path 17.

A recording-sheet returning roller 72 is driven by a drive motor 71 that is operable to return a recording sheet by way of a drive mechanism (not shown) such as a timing belt.

In the lower section of the housing 11, there are disposed a feeding cassette 18 for stacking and retaining a plurality of the recording sheets thereon, and a feeding roller 19 for feeding the recording sheet one at a time toward the secondary transfer section T2.

Provided below the double-sided image-forming unit 70 are a multi-purpose tray 81 forming a manual sheet feeding section 80; and a feeding roller 82 for feeding the recording sheet set in the multi-purpose tray 81 one at a time in the apparatus main body.

The developer 40, which is a rotary-type developer, is formed such that developing cartridges (not shown) of respective colors in which yellow toner, cyan toner, magenta toner, and black toner are respectively housed, are detachably mounted to a rotary member main body 41. The rotary member main body 41 rotates by a pitch angle of 90 degrees in a direction indicated by an arrow R, whereby a developing roller (not shown) provided in each of the developing cartridges is selectively brought into contact with the photosensitive member 21. Thus, selective development of the surface of the photosensitive member 21 is achieved.

The exposure unit 30 radiates the laser beam L toward the photosensitive member 21.

The intermediate transfer unit 50 has an unillustrated unit frame, a drive roller 54 which is rotatably supported on this frame, and the intermediate transfer belt 51 which extends in a tensioned manner by means of being wound around a plurality of driven rollers. The intermediate transfer belt 51 is rotationally driven in the direction indicated by arrows in the drawing. The primary transfer section T1 is formed at a contact portion between the photosensitive member 21 and the intermediate transfer belt 51, and the secondary transfer section T2 is formed at a nip portion between the drive roller and a secondary transfer roller 10*b*.

The secondary transfer roller 10*b* can be brought into contact with and separated from the drive roller 54 (i.e., brought into contact with and separated from the intermediate transfer belt 51), and at the time of contact, the secondary transfer section T2 is formed.

Therefore, for formation of a color image, in a state where the secondary transfer roller 10*b* is separated from the intermediate transfer belt 51, an image of a single color is formed on the intermediate transfer belt 51 by a single rotation thereof, accordingly, by a plurality of rotations of the intermediate transfer belt 51, images of a plurality of colors are superimposed on the intermediate transfer belt 51, thereby forming a color image. Thereafter, the secondary transfer roller 10*b* is brought into contact with the intermediate transfer belt 51, and a recording sheet is fed to the nip portion therebetween (the secondary transfer section T2). Thus, the color image (the toner image) is transferred (thereby attaining secondary transfer) onto the recording sheet from the intermediate transfer belt 51.

The recording sheet, on which the toner image has been transferred, passes through the fuser 60, whereby the toner image is fixed in a fusing manner, and is delivered toward the sheet-discharge tray section 15.

Figure 2:
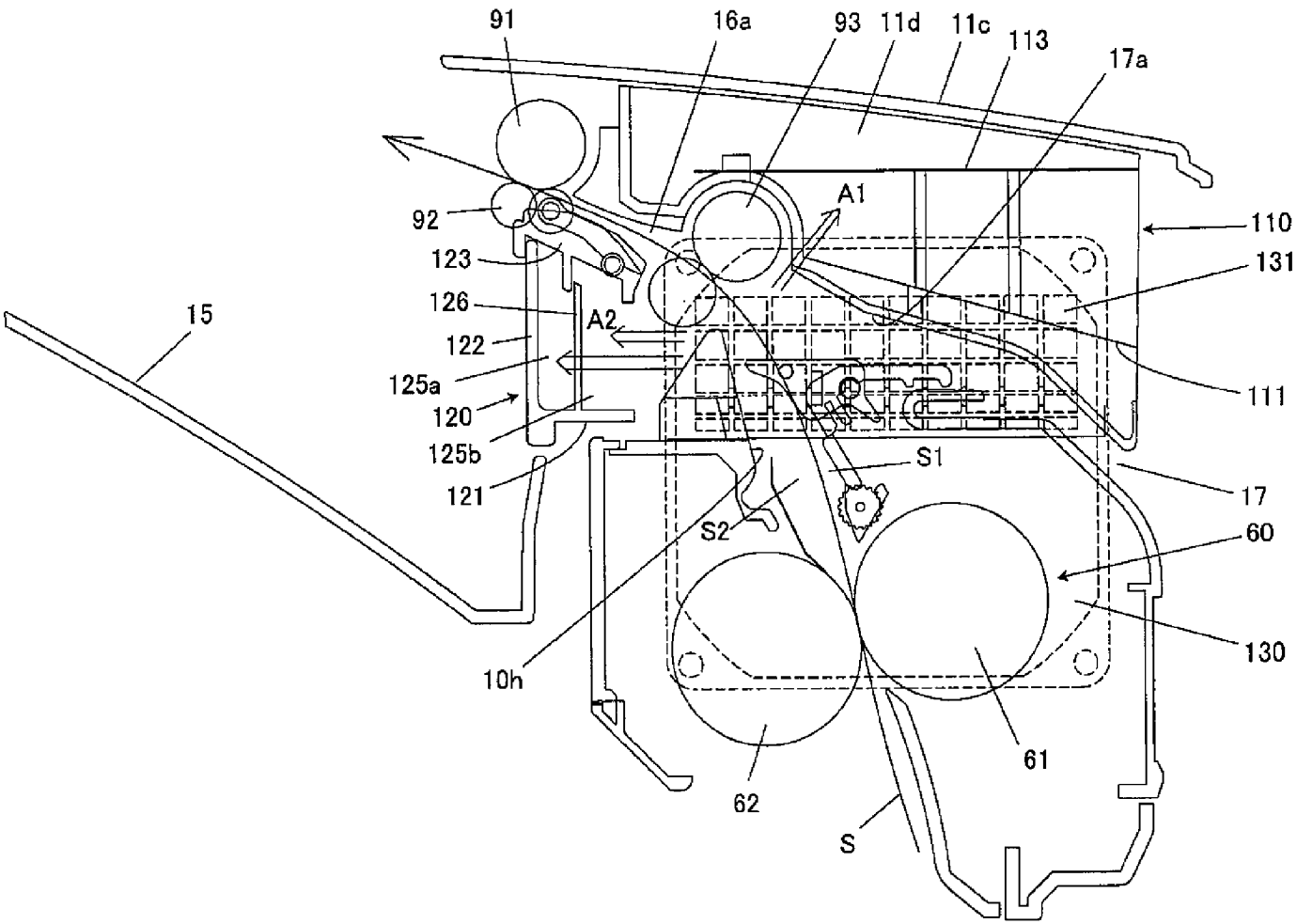
FIG. 2 is a schematic view showing a portion illustrated in FIG. 1 in an enlarged manner.

The fuser 60 has a pair of heating rollers 61 and 62 (see FIG. 2). A recording sheet S passes through the fuser 60 from the lower side to the upper side of the apparatus. After having passed from below upwardly through the fuser 60, the recording sheet S is discharged in a horizontal direction by means of a pair of switch-back rollers 93 and a pair of discharge rollers 91 and 92.

During fixing (during image-forming), the heating roller 61 is heated to about 165° C., and the heating roller 62 is heated to about 190° C. Therefore, the heating roller 62 located at the downstream side in a direction in which the recording sheet S is transported, is higher in temperature than the other heating roller 61.

The image forming apparatus includes the pair of discharge rollers 91 and 92 for discharging the recording sheet having passed through the fuser 61 onto the sheet-discharge tray 15, and the pair of switch-back rollers 93. The pair of switch-back rollers 93 are disposed between the fuser 60 and the pair of discharge rollers 91 and 92, and cause switch-back of the recording sheet having passed through the fuser 60, to thus return the sheet to the image-forming section formed from the photosensitive member 21, and the like.

The pair of switch-back rollers 93 are disposed on a discharge path 16*a* extending from the fuser 60 toward the pair of discharge rollers 91 and 92. Switch-back operation of a recording sheet is performed by means of reversing rotations of the pair of discharge rollers 91 and 92 and the pair of switch-back rollers 93 immediately before a rear end of the recording sheet passes through a nip portion of the pair of switch-back rollers 93, thereby feeding the recording sheet to the return path 17. The recording sheet having been fed to the return path 17 is transported by the return roller 72, and, after passing through a pair of gate rollers 10*g* for determining a feed timing of the recording sheet to the secondary transfer section T2, is fed to the secondary transfer section T2. Therefore, the recording sheet is transported to the image-forming section while turning inside out.

Figure 3:
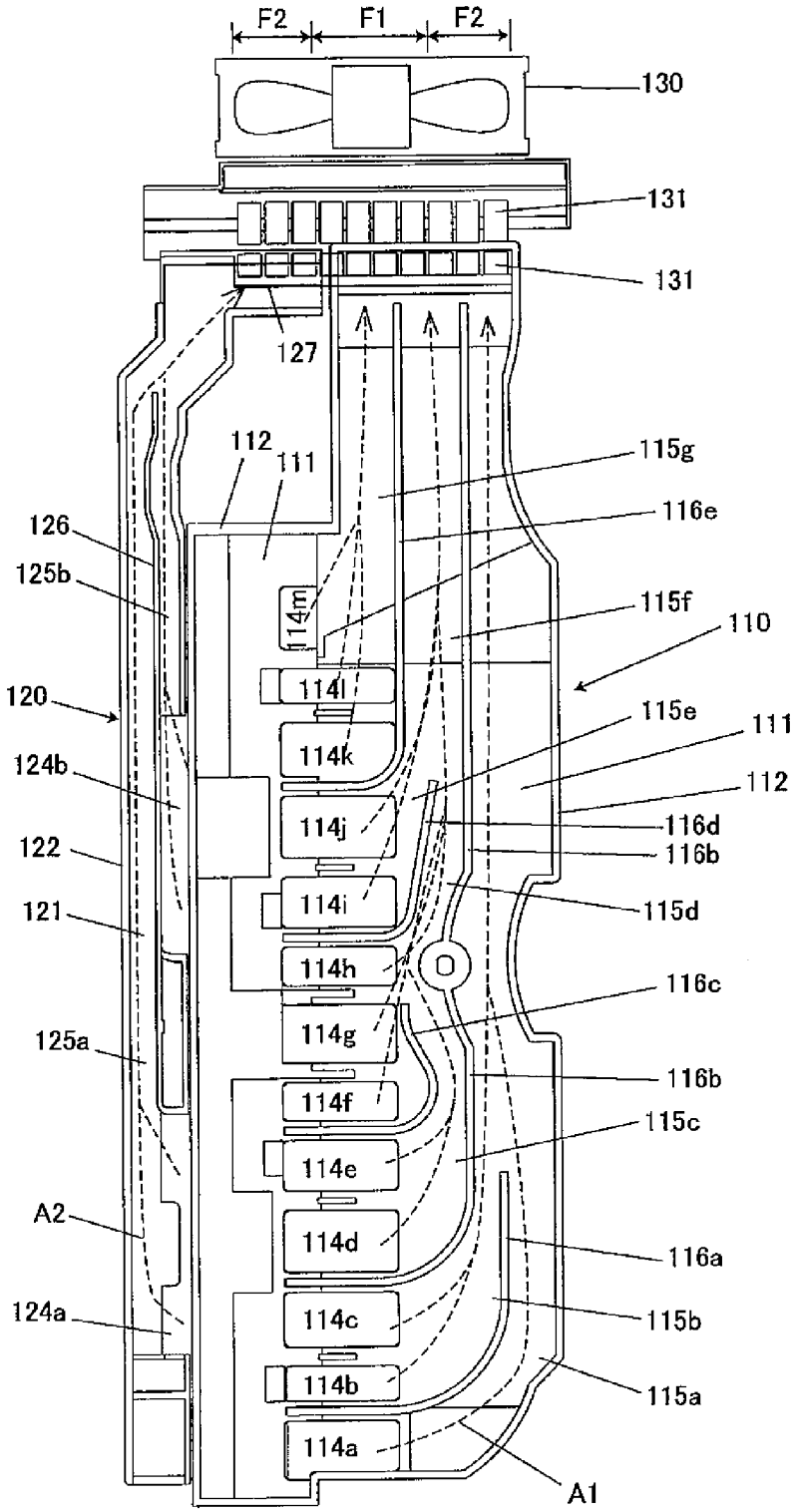
FIG. 3 is a plan view of an exhaust air duct.

As shown in FIGS. 2 and 3, the image forming apparatus has, between the fuser 60, and the discharge rollers 91 and 92, a first exhaust air duct 110 (see FIGS. 6A and 6B) on a front side S1 of the recording sheet S, and a second exhaust air duct 120 (see FIG. 4) on a back side S2 of the same. The first exhaust air duct 110 exhausts air on the front side S1 as indicated by an arrow A1. The second exhaust air duct 120 exhausts air on the back side S2 as indicated by an arrow A2.

As shown in FIG. 3, the respective exhaust air ducts 110 and 120 extend along an axial direction (the vertical direction in FIG. 3) of the pair of heating rollers 61 and 62 of the fuser 60, and communicate with a single exhaust fan 130 at terminal ends thereof.

Figure 5:
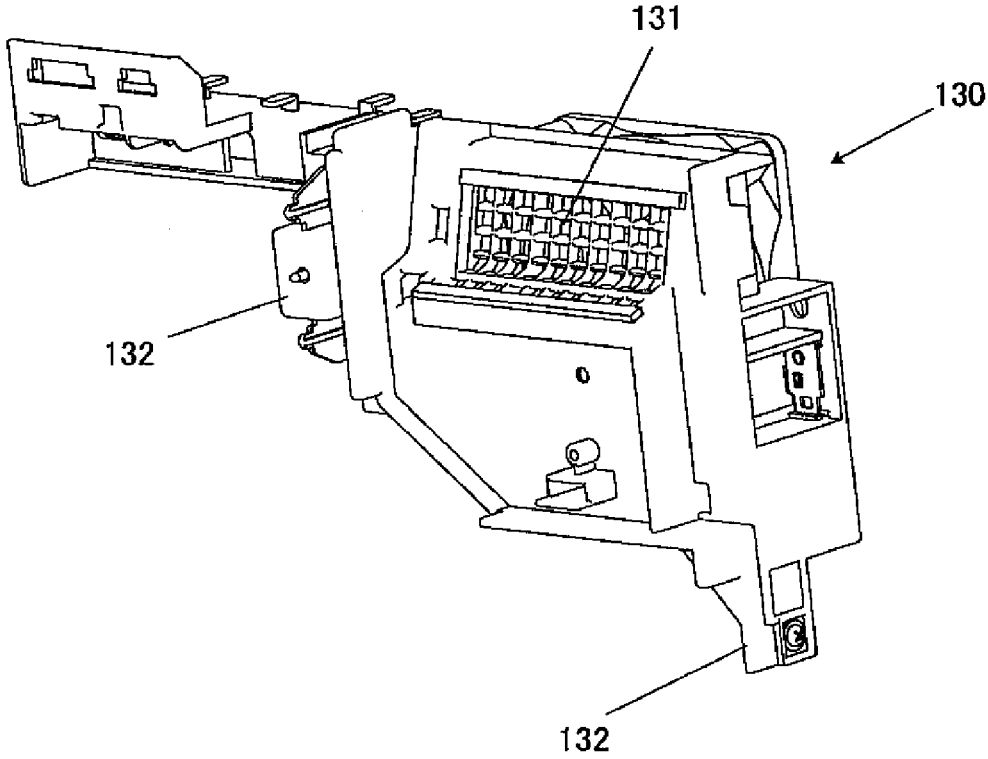
FIG. 5 is a perspective view of a fan (a fan unit).

In FIGS. 2, 3, and 5, a plurality of communication ports 131 communicate the exhaust air ducts 110 and 120 with the exhaust fan 130.

As shown in FIG. 5, the exhaust fan 130 is attached to an apparatus main body frame by using mounting portions 132.

As shown in FIG. 3, a suction force or a blast force of the fan 130 is weak at a center region F1 of the fan, and the same is strong at a periphery region F2 thereof.

Figure 6B:
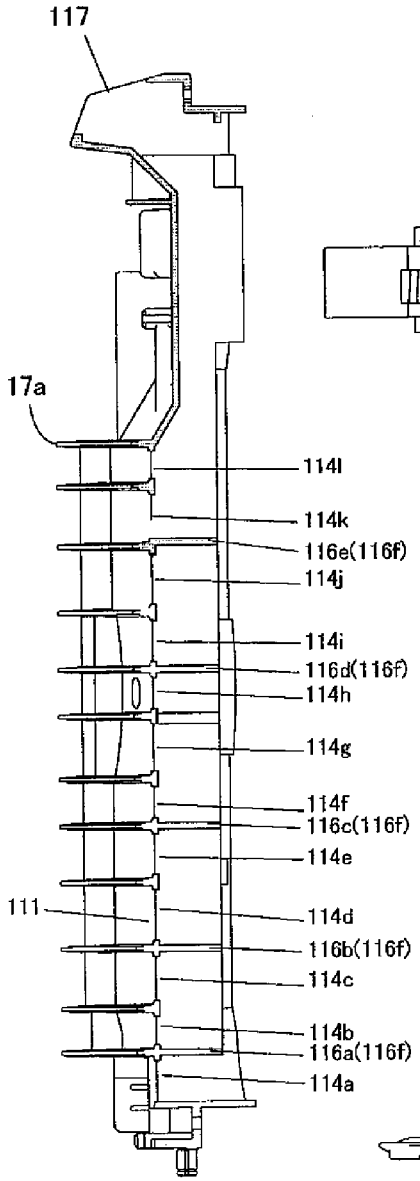
FIG. 6B is a cross-sectional view taken along a line b-b in FIG. 6A.
Figure 6A:
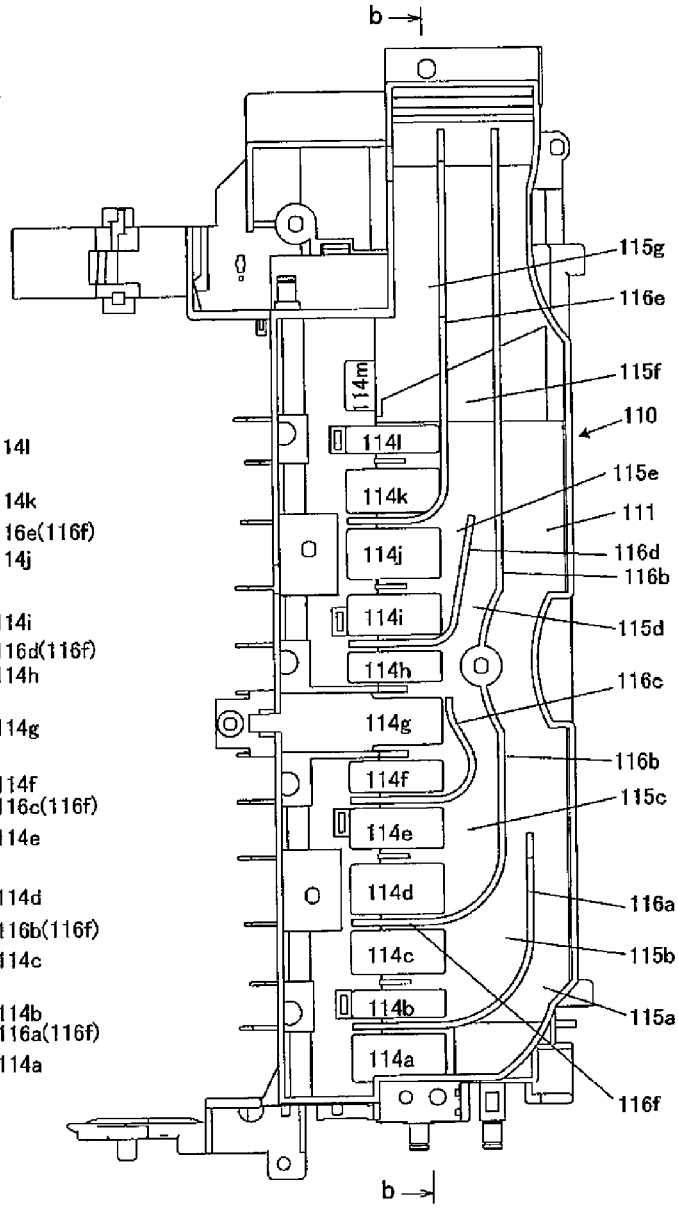
FIG. 6A is a plan view of a first exhaust air duct.
Figure 7:
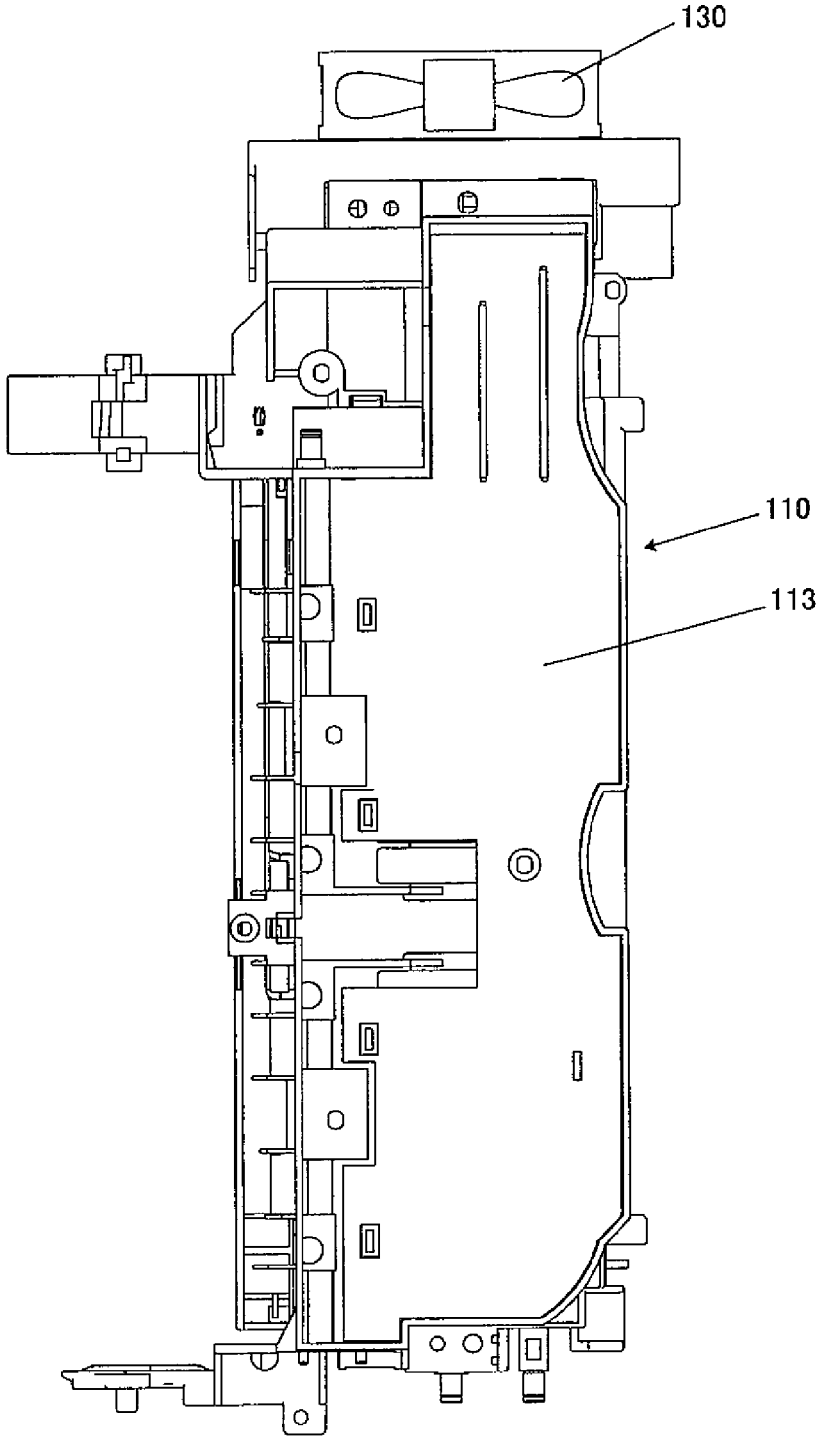
FIG. 7 is a plan view of a first exhaust air duct.

FIGS. 6A and 6B are a plan view and a cross-sectional view showing the first exhaust air duct 110 from which a sheet member 113, to be described later, is omitted. FIG. 7 is a plan view showing the first exhaust air duct 110 on which the sheet member 113, to be described later, is disposed.

As shown in FIGS. 2 and 3, the first exhaust air duct 110 has a bottom plate 111 which is inclined, a pair of side plates 112 formed integrally with the bottom plate 111, and the sheet member 113 (see FIGS. 2 and 7) which seals an upper portion (one face) of the duct. As shown in FIG. 6B, a connection port 117 for connecting to the exhaust fan 130 is formed in an end of the first exhaust air duct 110. Rib-shaped sheet guides 17*a* forming an upper portion of the return path 17 are formed integrally with a bottom face which is opposed to the above-mentioned one face.

As shown in FIGS. 1 and 2, the first exhaust air duct 110 is formed integrally with one side (in the present embodiment, a lower side) of a door cover 11*c*, which is a surface cover of the image forming apparatus as well as a door member of the same. The first exhaust air duct 110, together with the door cover 11*c*, can pivot (open/close) about a shaft section 10*j* illustrated in FIG. 1. The first exhaust air duct 110 is disposed above the fuser 60 with the sheet member 113 disposed between the first exhaust air duct 110 and the door cover 11*c*. As shown in FIG. 2, a cavity (space) 11*d* is formed between the sheet member 113 and the door cover 11*c*.

A plurality of suction ports 114*a* through 114*m* serving as a plurality of vent ports are formed in the bottom plate (bottom face) 111, which forms a single external surface of the first exhaust air duct 110, along the axial direction (the vertical direction in FIG. 3) of the pair of heating rollers 61 and 62 of the fuser 60. Partition plates 116*a* through 116*e* are disposed integrally with the bottom plate 111. The partition plates 116*a* through 116*e* form air paths 115*a* through 115*g* in correspondence with the suction ports 114*a* through 114*m*.

As shown in FIG. 2, the bottom plate 111 is a bottom face inclined in a direction in which the recording material S is guided. The suction ports 114*a* through 114*m* are formed in an upper portion (see FIG. 6A) of the bottom face 111.

The rib-shaped sheet guides 17*a* are disposed so as to be adjacent to the respective suction ports 114*a* through 114*m*. Each of the rib-shaped sheet guides 17*a*, and the portion 116*f* (see FIG. 6A) of each of the partition plates adjacent to the suction port, are formed in line with each other as illustrated in FIG. 6A.

Each of the partition plates 116*a* through 116*e* is formed such that the portion continuing from the portion 116*f* adjacent to the vent port is bent in relation to the portion 116*f* adjacent to the vent port.

Each of the suction ports 114*a* through 114*m* is open to a front side S1 (see FIG. 2) of the recording sheet S.

Therefore, air A1 sucked via the suction port 114*a* is exhausted to the outside of the apparatus by means of the exhaust fan 130 by way of the air path 115*a*. The air A1 sucked via the suction ports 114*b* and 114*c* is exhausted to the outside of the apparatus by means of the exhaust fan 130 by way of the air paths 115*b* and 115*a*. The air A1 sucked via the suction ports 114*d* and 114*e* is exhausted to the outside of the apparatus by means of the exhaust fan 130 by way of the air paths 115*c*, 115*d*, and 115*f*. The air A1 sucked via the suction ports 114*f*, 114*g*, and 114*h* is exhausted to the outside of the apparatus by means of the exhaust fan 130 by way of the air paths 115*d* and 115*f*. The air A1 sucked via the suction ports 114*i* and 114*j* is exhausted to the outside of the apparatus by means of the exhaust fan 130 by way of the air paths 115*e* and 115*f*. The air A1 sucked via the suction ports 114*k*, 114*l*, and 114*m* is exhausted to the outside of the apparatus by means of the exhaust fan 130 by way of the air path 115*g*.

In the present embodiment, an end portion of the air path 115*a*, among the air paths 115*a*, 115*f*, and 115*g*, along which a distance from the suction ports 114*a* through 114*c* to the exhaust fan 130 is long, is caused to oppose to the region F2 of the exhaust fan 130 where the suction force provided by the exhaust fan 130 is strong, and an end portion of the air path 115*g*, among the above-described air paths, along which a distance from the suction ports 114*k* through 114*m* to the exhaust fan 130 is short, is caused to oppose to the region F1 of the exhaust fan 130 where the suction force provided by the exhaust fan 130 is weak. In addition, an end portion of the air path 115*f*, among the above-described air paths, along which a distance from the suction ports 114*d* through 114*j* to the exhaust fan 130 is intermediate is caused to oppose to an area between the region F1 of the exhaust fan 130 where the suction force provided by the exhaust fan 130 is strong and the region F2 where the same is weak.

Accordingly, substantially uniform effects of air exhaust can be realized without changing sizes of the respective suction ports to a large extent.

Meanwhile, in the case where the fan 130 is used as a draft air fan, and the duct 110 is used as a draft air duct, the end portion of the air path 115*a*, among the air paths 115*a*, 115*f*, and 115*g*, along which a distance from the draft air ports 114*a* through 114*c* to the draft air fan 130 is long, is caused to oppose to the region F2 of the draft air fan 130 where a blast force provided by the draft air fan is strong, and the end portion of the air path 115*g*, among the above-described air paths, along which a distance from the draft air ports 114*k* through 114*m* to the draft air fan 130 is short, is caused to oppose to the region F1 of the draft air fan 130 where the blast force provided by the draft air fan is weak.

Figure 4:
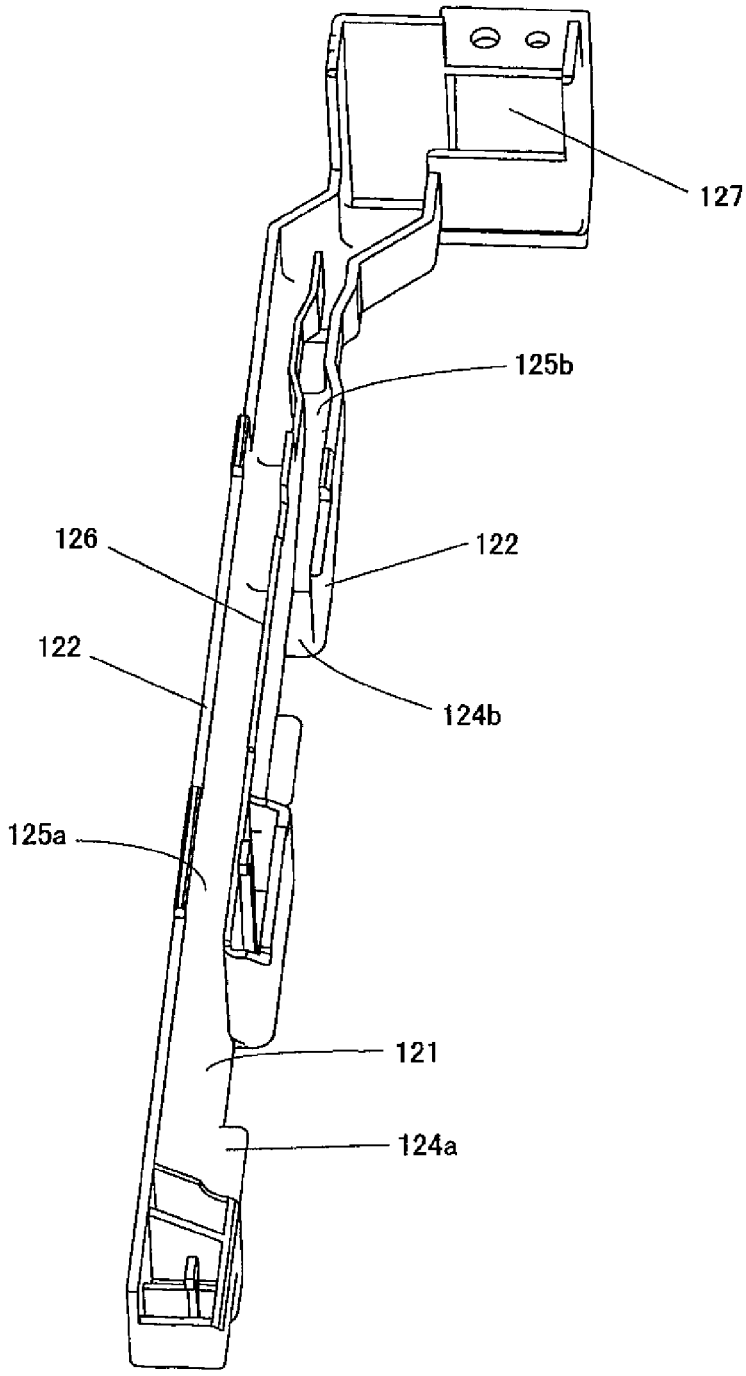
FIG. 4 is a perspective view of a second exhaust air duct.

As shown in FIGS. 2 to 4, the second exhaust air duct 120 has an overall shape of an elongated rod. The second exhaust air duct 120 includes a bottom plate 121, a side plate 122 which is integrally formed with the bottom plate 121, and a lid member 123 (see FIG. 2) that covers an upper portion of the duct. A connection port 127 for connecting to the exhaust fan 130 is formed in an end of the second exhaust air duct 120.

A plurality of suction ports (two suction ports in an example shown in FIGS. 3 and 4) 124*a* and 124*b* are disposed across the side plate 122 and the bottom plate 121, along the axial direction (the vertical direction in FIG. 3) of the pair of heating rollers 61 and 62 of the fuser 60. A partition plate 126 forming air paths 125*a* and 125*b*, which correspond to these suction ports 124*a* and 124*b*, is formed integrally with the bottom plate 121.

Each of the suction ports 124*a* and 124*b* is open to the back side S2 (see FIG. 2) of the recording sheet S.

Therefore, the air A2 suctioned via the suction port 124*a* is exhausted to the outside of the apparatus by means of the exhaust fan 130 by way of the air path 125*a*. The air A2 suctioned via the suction ports 124*b* is exhausted to the outside of the apparatus by means of the exhaust fan 130 by way of the air path 125*b*.

The present embodiment employs such a configuration in which the recording sheet S on which a toner image has been transferred in the image-forming section, passes through the fuser 60 having the heating rollers from the lower side to the upper side of the apparatus, and thereafter, the recording sheet S is discharged in the horizontal direction. Hence, water vapor is easily trapped inside (the side close to the second exhaust air duct 120) a moving path of the recording sheet S along which the recording sheet S moves upward and thereafter in the horizontal direction. To this end, as shown in FIG. 3, the end section 127 of the air paths 125*a* and 125*b* of the second exhaust air duct 120 is caused to oppose to the region F2 of the exhaust fan 130 where the exhaust force provided by the exhaust fan 130 is strong.

As a result, water vapor, which is apt to be trapped inside the moving path of the recording sheet S, can be exhausted favorably.

The image forming apparatus configured as above yields the following working effects.

The image forming apparatus which causes the recording sheet S on which a toner image has been transferred in the image-forming section, to pass through the fuser 60 provided with a heating roller, thereby fixing the toner image onto the recording sheet S, and thereafter discharges the recording sheet S to the discharge section 15 by means of the discharge rollers 91 and 92, is configured such that, between the fuser 60 and the discharge rollers 91 and 92, there are provided an exhaust air duct 110 for exhausting air A1 on the front side of the recording sheet, on the front side of the recording sheet S, and an exhaust air duct 120 for exhausting air A2 on the back side of the recording sheet, on the back side of the same. Accordingly, the air (accordingly, water vapor) A1 and A2 on the front side and the back side of the recording sheet S is exhausted through an area, between the fuser 60 and the discharge rollers 91 and 92, where water vapor emitted from the recording sheet S having passed through the fuser 60 is most easily trapped.

Hence, condensation on the sheet guide 10*h* (see FIG. 2) forming the transport path of the recording sheet S, and the like, can be prevented, thereby attaining smooth transportation of the recording sheet S having undergone fixing, without staining the same.

In particular, when the image forming apparatus is configured such that the recording sheet S on which a toner image has been transferred in the image-forming section, passes from below upwardly through the fuser 60 provided with the heating roller, condensation easily forms on the sheet guide 10*h*, or the like, above the fuser 60. However, according to the image forming apparatus, such condensation can be prevented, thereby attaining smooth transportation of the recording sheet S having undergone fixing, without staining the same.

When the image forming apparatus is configured such that the recording sheet S on which a toner image has been transferred in the image-forming section, is caused to pass from below upwardly through the fuser 60 provided with the heating roller, and thereafter is discharged in a horizontal direction, water vapor is easily trapped inside (the side close to the second exhaust air duct 120) a moving path along which the recording sheet S moves upward and thereafter moves in the horizontal direction. However, according to the image forming apparatus, such water vapor can be exhausted appropriately by means of the second exhaust air duct 120. Hence, the recording sheet S having undergone fixing can be transported smoothly without being stained.

When the image forming apparatus is configured so as to include the return path 17 for causing switch-back of the recording sheet S on which a toner image has been fixed in the fuser, at a portion between the fuser 60 and the discharge rollers 91 and 92, to thus return the recording sheet S to the image-forming section, and such that the sheet guide 17*a* (see FIG. 2) forming a part of the return path 17 is disposed above the fuser 60, condensation easily forms on the sheet guide 17*a*. However, according to the image forming apparatus, such condensation can be prevented. Hence, the recording sheet S having undergone fixing can be transported smoothly without being stained, thereby attaining formation of a clear image on each side of the recording sheet smoothly.

When the fuser 60 has a pair of heating rollers, water vapor is more easily emitted from each side of the recording sheet S. However, according to the image forming apparatus, such water vapor can be exhausted appropriately by means of the first exhaust air duct 110 and the second exhaust air duct 120. Hence, the recording sheet S having undergone fixing can be transported smoothly without being stained.

When the fuser 60 has a pair of heating rollers, and the heating roller 62 located at the downstream with respect to the direction along which the recording sheet S is horizontally transported, is higher in temperature than the other heating roller 61, more water vapor is emitted and easily trapped on the side of the recording sheet S closer to the high-temperature heating roller 62. However, according to the image forming apparatus, such water vapor can be exhausted appropriately by means of the first exhaust air duct 110 and the second exhaust air duct 120. Hence, the recording sheet S having undergone fixing can be transported smoothly without being stained.

Since the respective exhaust air ducts 110 and 120 extend along the axial direction of the heating rollers, and communicate with the single exhaust fan 130 at their terminal ends, the air A1 on the front side of the recording sheet S and the air A2 on the back side of the same can be exhausted by the single exhaust fan 130, thereby attaining cost reduction and miniaturization of the image forming apparatus.

The image forming apparatus has a first exhaust air duct 110, and the exhaust fan 130 disposed at an end portion of the first exhaust air duct 110. The first exhaust air duct 110 is provided with a plurality of suction ports 115*a*, 115*f*, and 115*g*, and a plurality of air paths communicating with one or a plurality of the suction ports. An end portion of the air path 115*a* among the air paths 115*a*, 115*f*, and 115*g* along which a distance from the suction ports 114*a* through 114*c* to the exhaust fan 130 is large, is caused to oppose to the region F2 of the exhaust fan 130 where the suction force provided by the exhaust fan is strong, and an end portion of the air path 115*g* among the air paths along which a distance from the suction ports 114*k* through 114*m* to the exhaust fan 130 is small, is caused to oppose to the region F1 of the exhaust fan 130 where the suction force provided by the exhaust fan is weak. Accordingly, among the plurality of suction ports in the first exhaust air duct 110, the suction ports 114*a* through 114*c* which are apart from the exhaust fan 130 are suctioned by the region F2 of the exhaust fan 130 where the suction force provided by the exhaust fan is strong by way of the long air path 115*a*. On the other hand, the suction ports 114*k* through 114*m*, which are close to the exhaust fan 130, are suctioned by the region F1, where the suction force provided by the exhaust fan 130 is weak, by way of the short air path 115*g*. The longer the air path, the greater the attenuation of the suction force provided by the exhaust fan 130. As a result, according to the embodiment, suction provided by the plurality of suction ports 114*a* through 114*m* in the first exhaust air duct 110 can be substantially equalized without changing the sizes of the suction ports 114*a* through 114*m*.

More specifically, according to the present invention, air-suction action can be attained through effective use of the region F2 of the fan 130 where the suction force provided by the fan is strong and the region F1 where the same is weak.

The exhausts ducts 110 and 120 are provided with a plurality of suction ports, and a plurality of air paths communicating with one or a plurality of suction ports are disposed. An end portion 127 of the air paths 125*a* and 125*b* among the air paths from which a greater amount of air is desirably suctioned, is caused to oppose to the region F2 of the exhaust fan 130 where the exhaust force provided by the exhaust fan is strong. Accordingly, the exhaust amount via the suction ports 124*a* and 124*b* from which a greater amount of air is desirably suctioned can be increased.

Therefore, according to the embodiment, favorable air exhaustion from both the front side and the back side of the recording sheet S can be attained by means of air-suction action in which the region F1 of the fan 130 where the suction force provided by the fan is strong and the region F1 where the same is weak are effectively utilized.

The image forming apparatus has the first exhaust air duct 110, and the exhaust fan 130 disposed at the end portion of the first exhaust air duct 110. The first exhaust air duct 110 is provided with a plurality of suction ports, and a plurality of air paths 115*a*, 115*f*, and 115*g* communicating with one or a plurality of the suction ports. An end portion of the air path 115*a* among the air paths 115*a*, 115*f*, and 115*g* along which the distance from the suction ports 114*a* through 114*c* to the exhaust fan 130 is long, is caused to oppose to the region F2 of the exhaust fan 130 where the suction force provided by the exhaust fan 130 is strong, and the end portion of the air path 115*g* among the air paths along which the distance from the suction ports 114*k* through 114*m* to the exhaust fan 130 is short, is caused to oppose to the region F1 of the exhaust fan 130 where the suction force provided by the exhaust fan 130 is weak. Accordingly, among the plurality of suction ports in the first exhaust air duct 110, the suction ports 114*a* through 114*c*, which are distant from the exhaust fan 130, are sucked by the region F2 where the suction force provided by the exhaust fan 130 is strong, via the long air path 115*a*. On the other hand, the suction ports 114*k* through 114*m*, which are close to the exhaust fan. 130, are sucked by the region F1 where the suction force provided by the exhaust fan 130 is weak, via the short air path 115*g*. The longer the air path, the greater the attenuation of suction force provided by the exhaust fan 130. As a result, according to the embodiment, suction provided by the plurality of suction ports 114*a* through 114*m* in the first exhaust air duct 110 can be substantially equalized without necessarily changing the sizes of the suction ports 114*a* through 114*m*.

More specifically, according to the embodiment, suction can be attained through effective use of the region F2 of the fan 130 where the suction force provided by the fan is strong and the region F1 where the same is weak.

In addition, the configuration described above can also be adopted in the case of forming a draft air duct. In this case, the draft air port among the plurality of draft air ports in the draft air duct, which is distant from the draft air fan is blown by the region where a blast force provided by the draft air fan is strong, by way of a long air path, and the draft air port which is close from the draft air fan is blown by the region where a blast force provided by the draft air fan is weak, by way of a short air path. The longer the air path, the greater the attenuation of the blast force provided by the draft air fan. Consequently, blast effects provided by the plurality of draft air ports in the draft air duct can be substantially equalized without necessarily changing the sizes of the draft air ports.

Provided in at least one external side surface of the duct 110 are the plurality of vent ports 114*a* through 114*m*, and the rib-shaped sheet guide 17*a*, for guiding the recording material S, adjacent to the vent ports 114*a* through 114*m*. In the duct 110, there are disposed the partition plates 116*a* through 116*e* for forming the air paths 115*a* through 115*g*, each communicating with a single or plurality of the vent ports 114*a* through 114*m*. Each of the ribs of the rib-shaped sheet guide 17*a*, and the portion 116*f*, of each of the partition plates, which is adjacent to the vent port are formed in line with each other. Accordingly, the air flow A1 passing through the vent ports 114*a* through 114*m* is rectified by the rib-shaped sheet guide 17*a* and the portion 116*f*, of the partition plate, which is adjacent to the vent port.

Accordingly, air of a desired portion (a portion where the vent port is formed) can be exhausted or blown effectively.

Furthermore, a rectification plate for providing the rectification effect at the vent port is formed from the rib-shaped sheet guide 17*a*. Accordingly, additional disposition of a rectification plate is not required.

The duct 110 is formed as an exhaust air duct, and a single external side surface of the duct 110 is formed as the bottom face 111 of the duct 110, the bottom face 111 is tilted in a direction along which the recording material S is guided, and the vent ports 114*a* through 114*m* are disposed above the tilted bottom face 111. Accordingly, hot air which rises from the fuser 60 can be exhausted still further effectively.

Each of the partition plates 116*a* through 116*e* is formed such that the portion continuing from the portion 116*f* adjacent to the vent port is bent in relation to the portion 116*f* adjacent to the vent port. Accordingly, flexibility in arrangement of the duct in enhanced, and air can be exhausted or blown effectively despite the air path being bent.

The duct 110 is formed integrally with the one side of the door member 11*c*, and the one face of the duct 110 is formed from the sheet member 113. Accordingly, the duct 110 is reduced in profile and weight, and, consequently, the door cover 11*c* having the duct 110 can be reduced in profile and weight.

Since the sheet guide 17*a* is formed from the other face 111 side of the duct 110, the door member 11*c* having the sheet guide 17*a* and the duct 110 can be formed to be further lightweight and low-profile.

Furthermore, since the duct 110 is employed as an exhaust air duct, suction imparted on the recording material S transported along the sheet guide 17*a* enables stable transportation of the recording material S.

The duct 110, serving as an exhaust air duct, is disposed above the fuser 60, and the sheet member 113 is disposed between the exhaust air duct 110 and the surface cover of the image forming apparatus. Accordingly, hot air and water vapor emitted from the fuser 60 can be exhausted in a favorable manner, and simultaneously, a heat insulation effect can be obtained by means of the sheet member 113. Hence, overheating of the surface cover 11*c* can be prevented.

Heretofore, the embodiment of the invention has been described. However, the invention is not limited thereto, and can be modified in various ways within the scope of the invention.

For example, in case a sirocco fan is employed in this invention, the invention can be configured as the same.

What is claimed is:

1. An image forming apparatus comprising:

a first path, in which a medium is adapted to be transported;

an image former, operable to form an image on at least one face of the medium;

a fuser, operable to fix the image on the medium;

a discharger, operable to discharge the medium;

a pair of ducts, arranged between the fuser and the discharger and at opposite sides of the first path, respectively, and adapted to exhaust air at the opposite sides of the first path, the pair of ducts extending in an axial direction of the fuser and communicating with a single fan at a terminal end of the ducts.

2. The image forming apparatus according to claim 1, wherein the medium on which the image is formed is passed through the fuser from a lower side to an upper side of the image forming apparatus in a first direction.

3. The image forming apparatus according to claim 2, wherein the medium is discharged by the discharger in a second direction substantially perpendicular to the first direction.

4. The image forming apparatus according to claim 1, further comprising a guide member, forming a part of a second path which is connected to the first path and in which the medium is adapted to be transported to the image former while turning inside out, and disposed at an upper side of the fuser.

5. The image forming apparatus according to claim 1, wherein the fuser includes a pair of heating rollers.

6. The image forming apparatus according to claim 3, wherein the fuser includes a pair of heating rollers, and one of the heating rollers which is located at a downstream side in the second direction is higher in temperature than the other heating roller.

7. An image forming apparatus, operable to form an image on a medium, comprising:

a door cover; and a duct, integrally formed with the door cover, wherein a first surface of the duct is comprised of a sheet member, a second surface of the duct is opposed to the first surface and comprises a guide adapted to guide the medium, the duct is located at an upper side of a fuser operable to fix the image on the medium, and the sheet member is arranged between the door cover and the fuser.

* * * * *